US005636711A

United States Patent [19]

Nussbaum

[11] Patent Number: 5,636,711

[45] Date of Patent: Jun. 10, 1997

[54] PLATFORM LIFT FOR MOTOR VEHICLE

[75] Inventor: Hans Nussbaum, Kehl-Sundheim, Germany

[73] Assignee: Otto Nussbaum GmbH & Co. KG, Kehl-Bodersweier, Germany

[21] Appl. No.: 524,819

[22] Filed: Sep. 7, 1995

[30] Foreign Application Priority Data

Sep. 7, 1994 [DE] Germany ..... 9414456 U

[51] Int. Cl.[6] ..... B66F 7/06

[52] U.S. Cl. ..... 187/211; 187/269; 182/141

[58] Field of Search ..... 187/211, 269; 254/122, 89 R; 182/141, 148

[56] References Cited

U.S. PATENT DOCUMENTS 4,848,732 7/1989 Rossato ..... 187/211

4,909,357 3/1990 Kawada ..... 187/211

FOREIGN PATENT DOCUMENTS 3833632 7/1989 Germany .

*Primary Examiner*—Kenneth Noland

*Attorney, Agent, or Firm*—Panitch Schwarze Jacobs & Nadel, P.C.

[57] ABSTRACT

A lifting platform for motor vehicles has at least one scissor-type framework with at least two lower scissor levers that cross each other and two upper scissor levers that cross each other. Either the upper or lower of two pivotably connected scissor levers is configured with a slot shape of a type which opens toward the other scissor lever, and this other scissor lever sinks at least most of the way into this slot when the platform lift is in its lowered position. Instead of a U-shaped slot configuration, the upper or lower of two pivotably connected scissor levers may have an L-shaped profile opening toward the other scissor lever and permitting it to sink into the crook of the L.

11 Claims, 3 Drawing Sheets

PLATFORM LIFT FOR MOTOR VEHICLE

FIELD OF THE INVENTION

The invention pertains to a lifting platform (platform lift) for motor vehicles with at least one support element which engages with the underside of the vehicle, and which is in turn supported on a base by means of a scissor-type framework. The scissor-type framework has at least two lower scissor levers that cross each other and two upper scissor levers that cross each other, and which in each case are joined with each other at the crossing points by means of first swivel bearings. In each case, the lower scissor levers are each joined in their upper regions with the lower regions of the upper scissor levers by means of second swivel bearings.

BACKGROUND OF THE INVENTION

Scissor-type platform lifts of this type are known in numerous forms of implementation. In general, two support elements are used therewith, both of which have available to them their own scissor-type framework, and which are arranged alongside each other in such a way that they engage under the vehicle on both sides.

Since the region of the bottom of the vehicle that is covered by the support elements is not accessible for repair work, the smallest possible size for the support elements is strived for. For that reason, it is known that for attaining an especially narrow design, the upper and the lower scissor levers are not to be arranged next to each other at their common end-mounted swivel bearings, but rather in alignment above one another. In this case, the bearing arrangement is carried out by means of laterally welded brackets which project beyond the scissor levers in the longitudinal and transverse directions in such a way that, in the folded state of the platform lift, the upper scissor levers lie flat on the lower ones. However, the support elements then stand a relatively large distance above the floor when the platform lift is lowered, so that when low-clearance vehicles or vehicles with very low spoilers are driven over them, damage can result. For that reason, platform lifts of this type must either be recessed into the floor or outfitted with long ramps for driving on and off.

If, instead of this, scissor frameworks are used in which the upper and lower scissor levers are arranged alongside of each other, a lower height above the floor is indeed attained. However, a greater overall width is then required. In addition, all of the swivel bearings must be configured as cantilevered bearings, which impairs the stability of the platform.

SUMMARY OF THE INVENTION

Starting from this point, an object of the present invention lies in improving the known platform lifts in such a way that, on the one hand, they are able to get by with narrow support elements, and on the other, they are distinguished by a low height above the floor when the platform lift has been lowered.

In accordance with the invention, this object is achieved by each of the upper or lower of two pivoting, linked scissor levers having a slot, track or opening, which runs in the longitudinal direction of the scissor lever and which is open in the direction of the other scissor lever, so that in the lowered position this other scissor lever sinks into this slot, at least for the most part. If, by way of example, the lower scissor levers are slotted, which is advantageous, then the upper scissor levers can sink completely into the lower scissor levers when the lifting platform is lowered, and thus require no overall height at all. The platform lift, in accordance with the invention, thus combines the advantages of the scissor-type frameworks with scissor levers arranged above each other and alongside each other, without having to accept the disadvantages of each. Not least of all, it is also distinguished by favorable manufacturing costs, because the welding of special brackets for the swivel bearings can be dispensed with.

In principle, the scissor levers which are to have the slot mentioned above can have any desired cross-sectional form. To achieve low-cost manufacture, however, it is especially advantageous for these scissor levers to make use of U-shaped profile iron. In this case, the scissor levers that sink in can be flat steel bars standing on edge.

It is beneficial that the swivel bearing that connects the lower and the upper scissor levers comprises a pin that protrudes into both of the opposing sides of the slot, and traverses the other scissor lever in the intermediate space. As a result of this, an especially stable bearing arrangement with little bending stress on the pin is obtained.

An especially advantageous further development of the invention comprises the scissor levers with the slot having lateral cutouts in the middle region for the above-mentioned first swivel bearing of the upper scissor lever. As a result, a complete coming together of the associated scissor levers is possible without the swivel bearing getting in the way. The same measure is still to be recommended, even if the upper scissor levers have the usual lateral link points for the introduction of the lifting force. It is beneficial that these cutouts are arranged on only one side of the slot.

So that the scissor levers do not lose any flexural strength as a result of the above-mentioned cutouts, reinforcements are provided on the side opposite the cutouts, by means of welded-on flat steel bars, for example.

BRIEF DESCRIPTION OF THE DRAWINGS

The foregoing summary, as well as the following detailed description of a preferred embodiment of the invention, will be better understood when read in conjunction with the appended drawings which show further features and advantages of the invention. For the purpose of illustrating the invention, there is shown in the drawings an embodiment which is presently preferred. It should be understood, however, that the invention is not limited to the precise arrangements and instrumentalities shown. It can also include combinations of individual features shown, described and/or claimed. In the drawings:

DETAILED DESCRIPTION OF PREFERRED EMBODIMENTS

Figure 1:
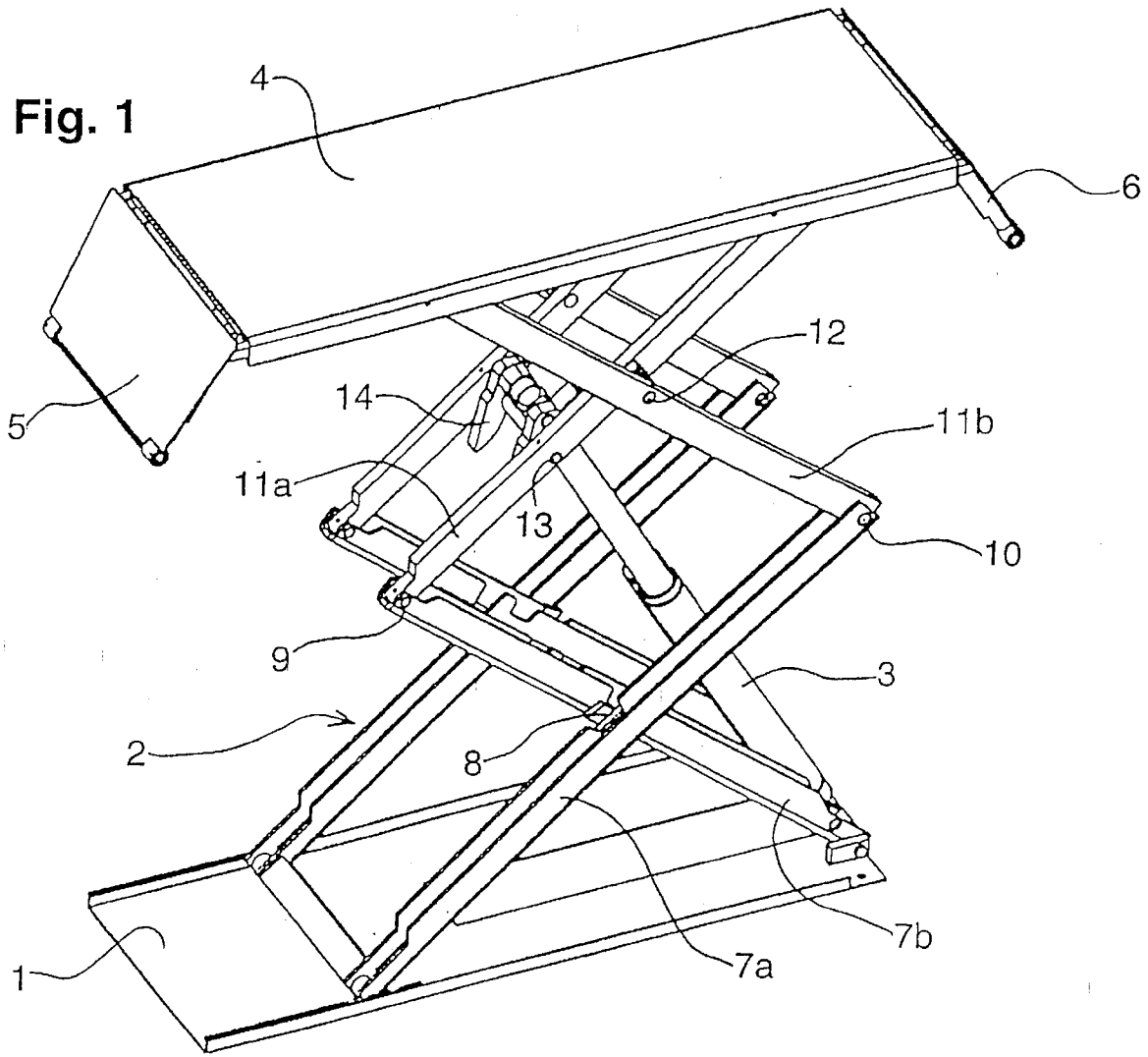
FIG. 1 shows one half of a platform lift with scissor-type framework, in a view.

In accordance with FIG. 1, the illustrated part of the platform lift, which is intended for the support of only one side of the vehicle, comprises a base plate 1, a scissor-type framework 2 mounted thereon and which can be raised and lowered by means of a lifting mechanism in the form of two hydraulic cylinders 3 connected in parallel with each other, and a support element in the form of a plate 4 mounted on the top of the scissor-type framework. Short, swiveling plates 5 and 6 are mounted at the front and back ends of the plate 4 in order to make it easier for the vehicle to be lifted to drive over it.

The scissor-type framework 2 will first be described only for the scissor levers lying towards the front in the drawing. In that regard, two lower scissor levers 7*a* and 7*b* that cross each other are provided, of which the one scissor lever 7*b* is linked to a fixed bearing of the base plate 1, while the other scissor lever 7*a*, in addition to its swiveling movement, is also guided on the base plate in such a way that it can move horizontally. Both scissor levers 7*a* and 7*b* are joined to each other at their crossing point by means of a swivel bearing 8, while both of them also have at their upper ends additional swivel bearings 9 and 10, to which the upper scissor levers 11*a* and 11*b* are linked. These levers run parallel to the lower scissor levers, and are joined to each other at their crossing point by means of a swivel bearing 12. At their upper ends, the upper scissor levers carry the support plate 4, and specifically, by means of the same bearing arrangement and guiding principle as is shown on the base plate 1.

Parallel to and behind the described scissor levers, the same scissor lever system is found once again in order to stabilize the support plate 4 with respect to tipping forces. The connection of these scissor-type systems to one another can be carried out in a variety of ways, which are known per se. The driving of the entire scissor-type framework is carried out by means of two cylinder-piston aggregates 3, which are linked at one end to the base plate 1 and act at the opposite end upon the upper scissor lever 11*a* specifically via link points 13.

Expansion levers 14 in accordance with German Utility Model 92 05 900 support the lifting movement from the folded state of the scissor levers until the lifting mechanism has swung out sufficiently from the lower dead-center position.

Figure 2:
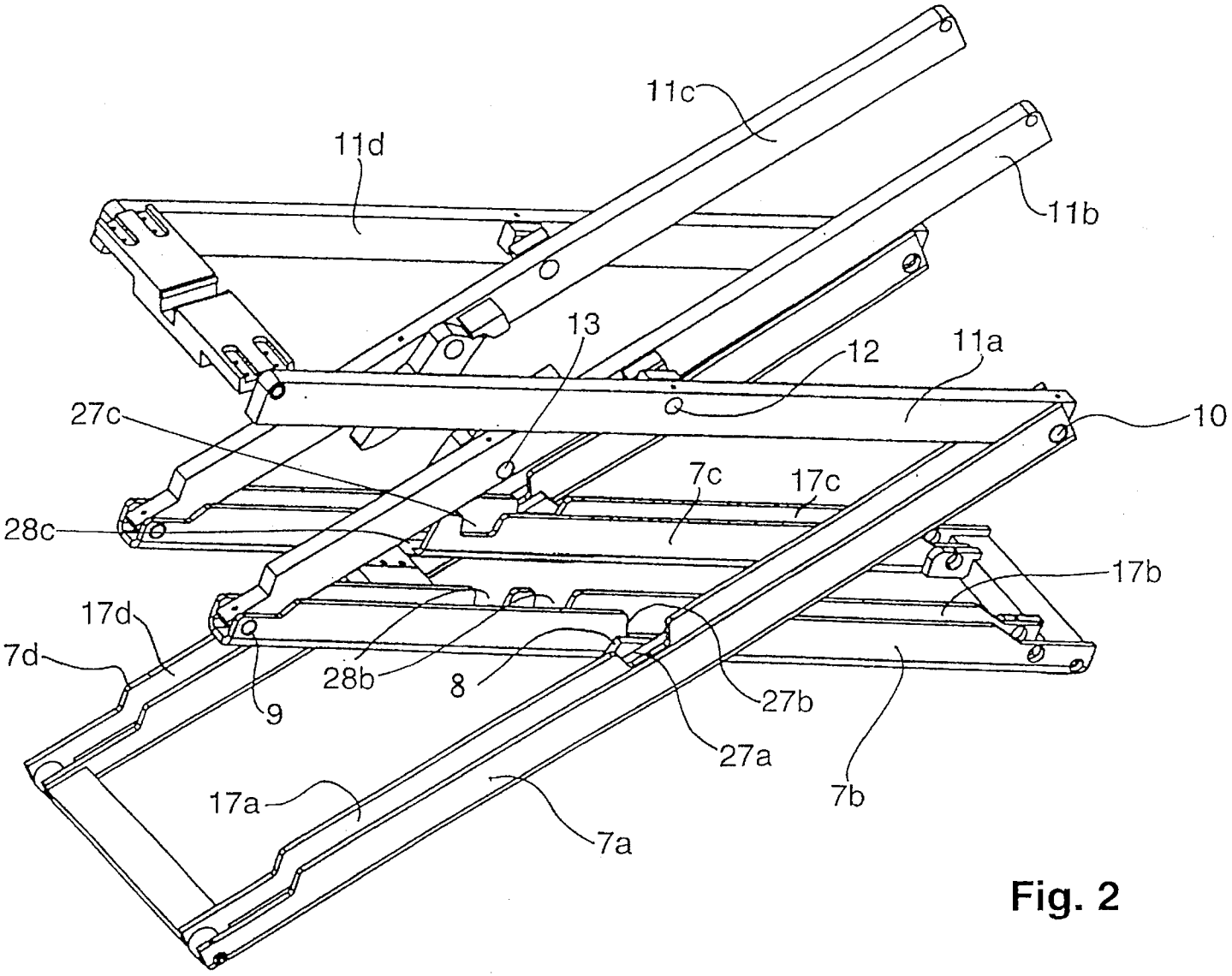
FIG. 2 shows an enlarged representation of the scissor-type framework in a perspective view with the support element and base plate removed, as well as without the lifting mechanism.

It is important that the lower scissor levers 7*a* through 7*d*—see FIG. 2—be configured as U-profiles with upwardly opening slots 17*a* through 17*d*, and that the upper scissor levers 11*a* through 11*d* be configured as rectangular profile members aligned therewith and which fit into these slots, so that when the platform lift is lowered, profile members disappear practically completely into the slots.

In order that this sinking is not interfered with by the swivel bearings 12 between the upper scissor levers at the upper scissor levers, the lower scissor levers 7*a* and 7*b* have matching cutouts 27*a* through 27*d* on the inner and/or outer sides of the U-profile, all of which are open towards the top. In addition, the inner scissor levers 7*b* and 7*c* have on their inner sides additional cutouts 28*b* and 28*c* for the link points 13 of the lifting mechanism. The limb regions of the U-profile that lie opposite these cutouts are all reinforced by means of a welded-on flat steel bar or the like.

Figure 3:
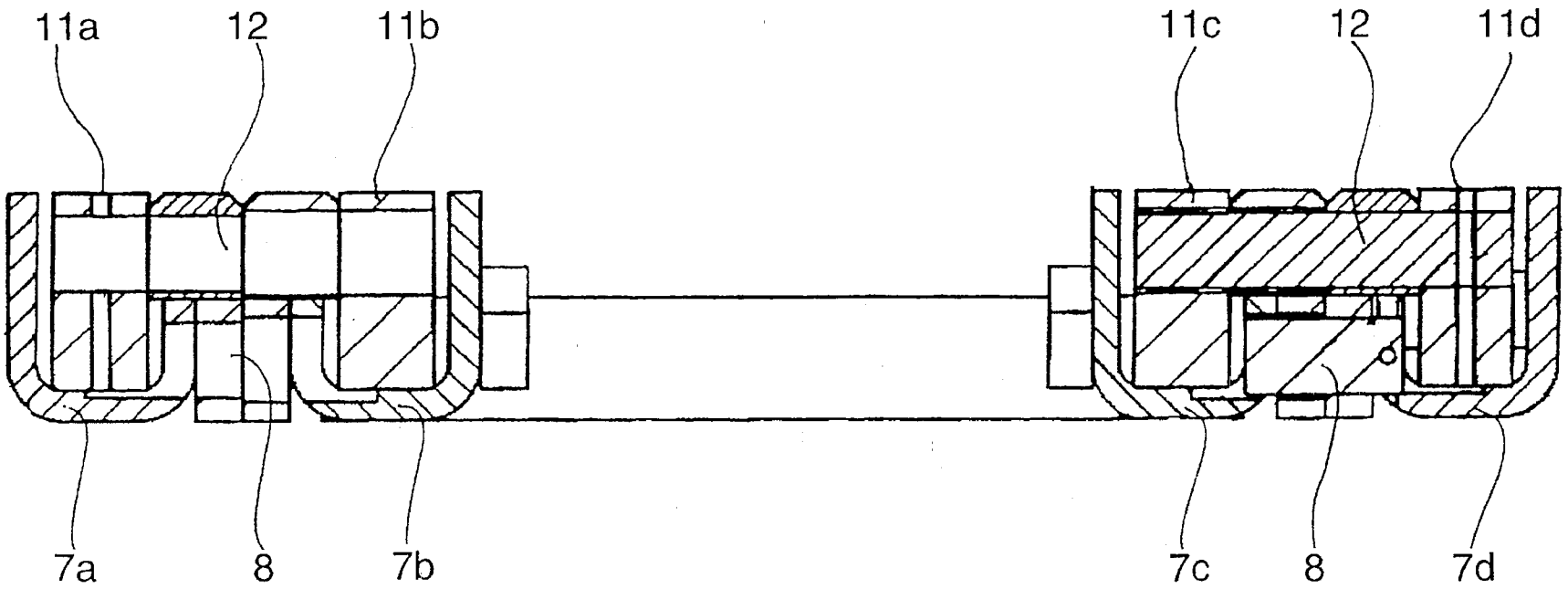
FIG. 3 shows a cross-section through the scissor-type framework in its lowered state.

The cross-section, shown in FIG. 3, through the scissor-type framework shows the scissor levers in the folded state. It can be seen that the upper scissor levers have sunk completely into the lower scissor levers, and do not require any additional space at all.

Of course, it is within the scope of the invention to reverse the arrangement; that is, to position the slotted scissor levers on top and the scissor levers that sink into the slots on the bottom. In the same way, other cross-sections which exhibit slots open to the top or to the bottom can also be used in place of the illustrated U-profile.

Finally, it is also within the scope of the invention to configure the scissor levers not with a slot restricted on both sides, but rather to use scissor levers with an L-shaped profile that opens toward the other scissor lever so that the other scissor lever can sink into the L-profile when the lifting platform is in its lowered position. This can easily be imagined with the aid of FIG. 2. There, by way of example, all of the outside side walls of the U-profile of the outside scissor levers 7*a* and 7*d* and all of the inside side walls of the U-profile of the scissor levers 7*b* and 7*c* could be dispensed with, if a flying bearing arrangement were provided at the swivel bearings 9 and 10. Instead of that, all of the other side walls of the U-profiles could be dispensed with, if the swivel bearing 8 were moved from the side wall to the underside of the profile, which could be possible in the case of the swivel bearings 9 and 10 as well.

By way of summary, by means of the present invention, a scissor-type framework is thus provided which can be built not only narrow, but extremely flat as well, while at the same time being distinguished by great stability. Along with its use in repair shops, it is, of course, also well-suited for use as a lifting device in multiplex parking systems.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A platform lift for a motor vehicles, comprising at least one support element (4) which engages with the underside of a motor vehicle, said support element being supported on a base (1) by a scissor-type framework (2) operable between a raised and a lowered position, the scissor-type framework having at least two lower scissor levers (7*a*, 7*b*) that cross each other and two upper scissor levers (11*a*, 11*b*) that cross each other, each pair of levers being respectively pivotably joined together at points of crossing each other by first swivel bearings (8, 12), each of the lower scissor levers (7*a*, 7*b*) being joined in their upper regions with lower regions of the upper scissor levers (11*a*, 11*b*) by second swivel bearings (9, 10), the upper (11*a*, 11*b*) or the lower (7*a*, 7*b*) of two pivotably joined scissor levers having a slot (17*a*, 17*b*) which extends in a longitudinal direction of the scissor lever, said slot being open towards the scissor lever pivotably joined thereto, and the scissor lever pivotably joined thereto being configured so as to sink at least most of the way into said slot (17*a*, 17*b*) when the platform lift is in its lowered position.

2. The platform lift in accordance with claim 1, wherein the scissor lever which sinks into said slot lies flat against the bottom of the slot (17*a*, 17*b*) when the platform lift is in its lowered position.

3. The platform lift in accordance with claim 1, wherein the scissor lever having the slot (17*a*, 17*b*) is configured as an approximately U-shaped profile member.

4. The platform lift in accordance with claim 1, wherein the scissor lever that sinks into the slot is a flat steel bar standing on edge.

5. The platform lift in accordance with claim 1, wherein the second swivel bearing (9, 10) comprises a pin that protrudes into both opposing sides of the slot (17*a*, 17*b*), and traverses the scissor lever that sinks into the slot in an intermediate space there between.

6. The platform lift in accordance with claim 1, wherein the scissor levers having the slots have in their middle region lateral cutouts (27*a*, 27*b*) for the swivel bearing (12) of the scissor levers which sink into the slot.

7. The platform lift in accordance with claim 1, wherein the scissor levers having the slots have additional lateral cutouts (28*b*) for linking to a lifting mechanism.

8. The platform lift in accordance with claim 6 wherein the scissor levers having the slots are reinforced on a side of the slot lying opposite to the cutouts (27*a*, 27*b*).

9. The platform lift in accordance with claim 7, wherein the scissor levers having the slots are reinforced on a side of the slot lying opposite to the cutouts (28*b*).

10. The platform lift in accordance with claim 1, wherein the scissor levers that cross each other are connected to the first swivel bearings (8, 12) by a flying bearing arrangement.

11. The platform lift in accordance with claim 1, wherein the scissor lever having the slot is configured as an L-shaped profile member.

* * * * *